United States Patent [19]

Brucker

[11] 4,027,339

[45] June 7, 1977

[54] HOCKEY GLOVE WITH IMPROVED PALM CONSTRUCTION

[76] Inventor: Ben B. Brucker, 240 N. Crescent St., Beverly Hills, Calif. 90210

[22] Filed: June 17, 1976

[21] Appl. No.: 696,985

[52] U.S. Cl. ..... 2/16; 2/161 A

[51] Int. Cl.[2] ..... A41D 13/10

[58] Field of Search ..... 2/161 A, 16, 159, 167, 2/20, 165

[56] References Cited

UNITED STATES PATENTS

| | | | |
|---|---|---|---|
| 3,605,117 | 9/1970 | Latina | 2/16 |
| 3,626,515 | 12/1971 | Murray | 2/16 |

*Primary Examiner*—G. V. Larkin

*Attorney, Agent, or Firm*—Sughrue, Rothwell, Mion, Zinn & Macpeak

[57] ABSTRACT

A hockey glove which is heavily padded on its back including the finger and thumb stalls has a flexible body member formed of seam joined palm and back flexible sheet material portions, the palm portion being made of waterproofed top grained boar hide. The thumb stall has its back wall partially formed by a folded over strip whose ends are seam stitched to the edge of the back sheet material portion carrying the padding and to the thumb section of the palm sheet material portion. The thumb stall palm sheet material portion further comprises multiple plies of the boar hide sheet material to reinforce the thumb stall. The tip of the free thumb stall is stitched to the padded back sheet material portion-.Other portions of the palm sheet material portion are reinforced with additional layers of waterproof top grain boar hide at the wear points.

5 Claims, 4 Drawing Figures

HOCKEY GLOVE WITH IMPROVED PALM CONSTRUCTION

BACKGROUND OF THE INVENTION

1. Field of the Invention

This invention relates generally to a padded hockey glove and more particularly to a hockey glove having a palm material effectively waterproofed and which provides reinforcement at the wear points without compromising the strength and flexibility of the palm sheet material.

2. Description of the Prior Art

Padded hockey gloves are generally employed by the ice hockey participants to protect the hands of the participants in this rough and tumble sport. The necessity for providing heavy padding to the back of the hockey glove limits the flexibility of the glove which, in turn, hampers the participant in handling of the hockey stick during the sporting event. Attempts have been made to provide a flexible thin sheet material for the palm of the glove to permit the encased hand to readily grasp the handle of the hockey stick. Such flexible material in the past where it is of the proper flexibility, is not waterproof, causing the hockey player's hands to be both wet and cold, adversely effecting the gripping of the hockey stick through the flexible palm portion of the glove. Further, these flexible materials have resulted in a glove construction which is both subject to wear and of tearing of the stitching at the seamed areas between the front and back sheet material portions defining the outer surfaces for the glove.

SUMMARY OF THE INVENTION

The present invention is directed to an improved hockey glove construction which provides an improved flexible and durable palm sheet material portion to the glove with a high flexibility and without compromising the wearing qualities of the glove and with little propensity for ripping out at the seams. The improved padded hockey glove of the present invention comprises a hollow flexible hand receiving body member formed of seamed joined, palm and back flexible sheet material portions which include integral thumb and finger stalls, at least partially formed by the seamed back and palm sheet material portions. The padding is carried by the glove body member on the outside of the back sheet material. The improvement resides in the palm sheet material portion being formed of waterproofed top grained boar hide with the thumb stall of the glove being formed by a thumb stall back wall boar hide strip folded in half and stitched at respective edges to the back flexible sheet material portion and to a double ply sheet material assembly including a thumb stall section of the palm sheet material portion. The tip of one end of the folded stall back wall boar hide strip is sewn to the tip ends of the back sheet material portion partially defining the thumb stall. A boar hide wear patch configured to and of slightly smaller size than the thumb stall portion section of the plam sheet material portion is stitched about its edges to that thumb section forming a triple layer overlying the palm side of the inserted thumb to reinforce the glove thumb stall in the area of maximum wear.

The individual finger sections of the palm sheet material portion are essentially square to provide increased flexibility to the individual finger stalls to facilitate grasping of the hockey stick by the glove wearer. Palm reinforcing strips are stitched to palm sheet material portion from the wrist to the index finger facing the thumb stall to reinforce the palm in the area of reception of the hockey stick handle.

DESCRIPTION OF THE PREFERRED EMBODIMENT

Figure 1:
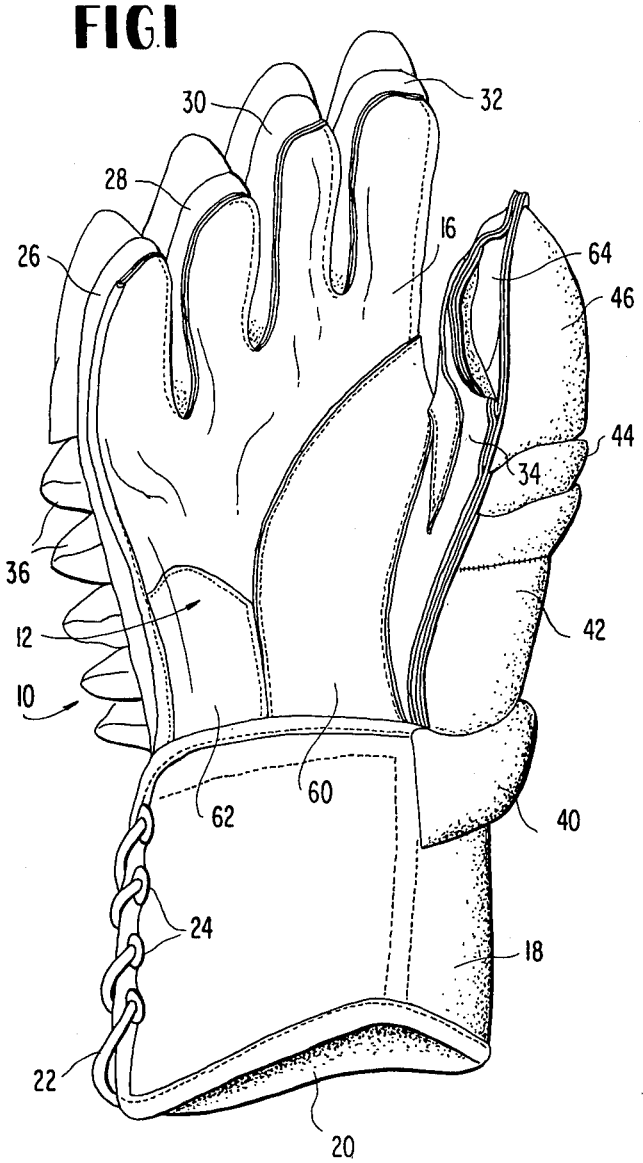
FIG. 1 is a front palm perspective view of one embodiment of the improved padded hockey glove of the present invention.
Figure 2:
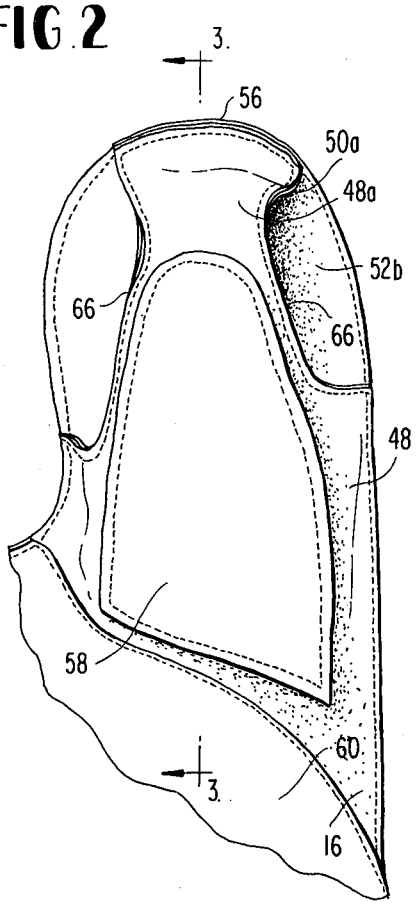
FIG. 2 is an enlarged elevational view of the thumb stall of the hockey glove of FIG. 1.

Referring to the drawings, there is shown a hockey type padded glove indicated generally at 10 which in this case constitutes a right hand glove for the hockey participant or player, the left hand glove being essentially the mirror image of the right hand glove and not shown.

The glove 10 includes a front or palm portion indicated generally at 12 and a rear or back portion indicated generally at 14, the front portion 12 being formed essentially of a palm flexible sheet material portion 16 which along with a relatively rigid leather cuff 18 and the back 14 of the glove forms a hollow glove body with access to the interior thereof being through an opening 20 within cuff 18. A lace 22 which is suitably passed through grommets 24 within the cuff 18 carried along opposed edges permits the cuff 18 to be tightened about the wrist of the wearer once the hand is inserted within opening 20. The back and front sheet material portions define for the body member four finger stalls indicated at 26, 28, 30 and 32 from the little finger stall to the index finger stall, there also being provided a thumb stall at 34 for reception of the thumb of the wearer.

The palm sheet material portion 16 (sections of which are more than one ply) comprises top grain boar hide which give maximum strength to this portion of the glove along with the flexibility needed to permit the wearer to readily grasp the handle or shaft of the hockey stick (not shown). Further, waterproofing material is supplied to both sides of the palm sheet material 16, preferably in the form of silicone, this giving longer life to the leather, prevents shrinking and hardening of the leather palm and reduces the general deterioration of the leather due to loss of natural oil. As may be seen in FIG. 1, the back 14 of the glove is heavily padded by way of fabric covered padded portion 36 between the cuff 18 and the first joint of the wearer's finger in the area of inception of the projecting stalls 26–32 for the fingers. Preferably, in order to properly protect the thumb, the thumb stall 34 on the back of the glove is provided with relatively inflexible leather padding in the form of separate portions 40, 42, 44, and 46 extending completely from the cuff 18 and in fact overriding a portion of the same to the tip of the thumb stall 34.

Figure 3:
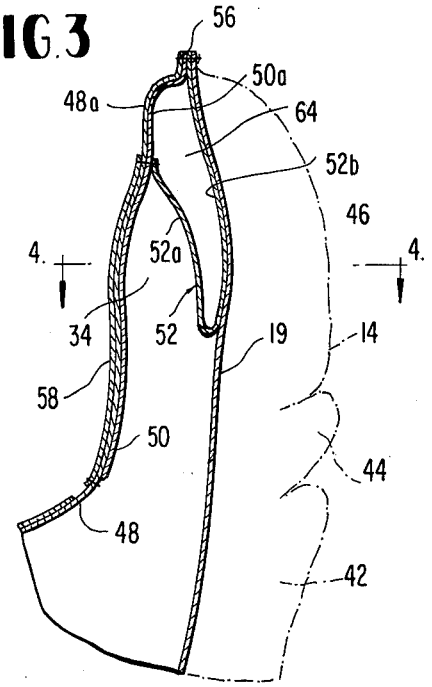
FIG. 3 is a sectional view of the thumb stall of FIG. 2 taken on line 3—3.
Figure 4:
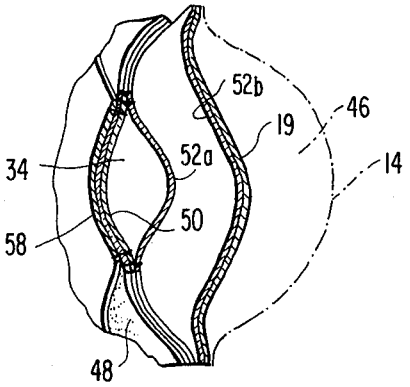
FIG. 4 is a sectional view of the thumb stall of FIG. 3 taken on line 4—4.

The necessity of providing relatively rigid hard leather protective segments as at 44 and 46 and especially 46 to the thumb stall 34, prevents in the absence of the construction of the present invention sufficient flexibility to the thumb to permit the wearer of the glove to properly grasp the hockey stick. In order to achieve this flexibility and provide a waterproof thumb stall, in addition to thumb section 48 of palm sheet material portion 16, FIGS. 3–4, the thumb stall 34 is formed by an inner reinforced boar hide material strip 50 which extends from the base or first joint of the thumb to beyond the extreme tip of stall 34 as does palm sheet material section 16. These extension portions are indicated at 48*a* and 50*a*. Further, in order to define the thumb stall 34, a further boar hide strip indicated generally at 52 is folded at its center and a pad contact strip portion 52*b* which is of somewhat longer length than stall forming portions 52*a* extends to the tip of pad portion 46 and which is sewn or stitched commonly to the outer ends of extension portions 48*a* and 50*a* at 56, FIG. 3. The end of the stall back wall portion 52*a* of strip 52 is sewn to the thumb strip 50 overlying palm sheet material portion 16 at a point inwardly of the thumb tip 56 commonly with the upper end of reinforcing wear patch 58. Wear patch 58 is sewn about its edges to the outside of the palm material thumb section 48 to provide maximum reinforcement at the wear area of the thumb stall on the side facing the hockey stick (not shown) which is grasped between the thumb and the remaining portion of the palm material 16. In that respect, the palm sheet material portion 16 is further reinforced by top grain boar hide strips 60 and 62 starting at the point of intersection between the palm sheet material 16 and cuff 18 and extending towards the finger stalls 26–32, the strip 60 extending the full length of the crotch between the thumb and the palm and generally facing the reinforced area of the thumb stall 34, while the palm reinforcing strip 62 extends only a short distance along the side edge of the glove as an additional reinforcement. The flexible relatively thin palm sheet material is formed of the waterproofed top grain boar hide as are reinforcing strips 60 and 62. The strip 62 terminates far short of the first joint of the small finger stall 26 with which it is longitudinally aligned. It is to be noted that in the formation of the flexible finger stalls, an air gap 64 is formed by the folded over thumb stall back wall strip 52, the side edges of strip 52 being sewn as indicated at 66 commonly to the thumb section 48 of the palm sheet material portion 16 and to reinforcement strip 50 which extends longitudinally not only the length of stall 34 but beyond the same for flexible connection by way of strip portions 48*a* and 50*a* to the relatively rigid tip 56 of the pad section 46.

It may be further seen by reference to FIG. 1, the fact that the various finger stalls are formed by cutting the finger sections of the palm sheet material portion 16 essentially rectangular rather than tapered to insure additional room for reception of the fingers within the various stalls 26–32 inclusive.

Further, extra reinforcement may comprise leather darts formed of the top grain boar hide which are sewn between the fingers on the inside of the palm sheet material 16 to allow for extra relative expansion of the gap between the finger while reducing the usual stress at the end of the cut defining the individual stalls 26, 28, 30 and 32 for the palm sheet material portion 16 which often causes splitting of the seams or tearing of the leather where this material is sewn to the back material portion 12 or to intermediate strips at the respective finger stalls.

While the invention has been particularly shown and described with reference to a preferred embodiment thereof, it will be understood by those skilled in the art that various changes in the form and details may be made therein without departing from the spirit and scope of the invention.

What is claimed is:

1. In a padded hockey glove comprising: a hollow flexible hand receiving body member formed of seam joined palm and back flexible sheet material portionns including integral thumb and finger stalls at least partially formed by said seamed back and palm sheet material portions, padding carried by said glove body member on the outsdie of the back sheet material including the thumb and finger stall area, the improvement wherein: said palm sheet material portion is formed of waterproofed top grain boar hide, and the thumb stall is formed by a stall back wall waterproofed top grain boar hide strip folded at the middle and stitched at its edges to respective edges of said back sheet material portion and the palm sheet material portion of said glove body member, one end of said folded stall back wall strip being sewn to the thumb stall section of said palm sheet material portion at a point longitudinally inward of the end of that section and the other end of said stall back wall strip being stitched commonly to the end of said thumb stall section of said palm sheet material portion to form a gap between the padded portion of said thumb and the thumb stall to permit the wearer's thumb to flex inwardly and to permit ready grasping of the hockey stick carried thereby.

2. The padded hockey glove as claimed in claim 1, wherein said thumb stall on the palm side of the glove comprises two plies of said top grain boar hide including as one ply the thumb section of said palm sheet material portion.

3. The padded hockey glove as claimed in claim 2, wherein said top grain boar hide is silicone coated on both sides thereof to waterproof the same.

4. The padded hockey glove as claimed in claim 3, wherein said palm sheet material includes integral finger sections which are rectangular at their tips to increase the flexibility of the glove finger stalls and said glove further comprises additional top grain boar hide palm reinforcing strips extending from the wrist portion of the glove towards said finger stalls, terminating short of said finger stalls and facing said reinforced thumb stall, and wherein at least one of said strip portions fully overlies the crotch between the thumb and the palm adjacent the index finger stall.

5. The padded hockey glove as claimed in claim 1, wherein said top grain boar hide is silicone coated on both sides thereof to waterproof the same.

* * * * *